United States Patent [19]

Kouros

[11] 4,386,775

[45] Jun. 7, 1983

[54] HAND SUPPORT FOR BOWLING

[76] Inventor: Thomas C. Kouros, 440 Creekwood Dr., Palatine, Ill. 60067

[21] Appl. No.: 283,918

[22] Filed: Jul. 16, 1981

[51] Int. Cl.[3] ..... A63B 69/00

[52] U.S. Cl. ..... 273/54 B; 2/161 A

[58] Field of Search ..... 273/54 B; 128/87 A; 2/161 A

[56] References Cited

U.S. PATENT DOCUMENTS 3,788,307 1/1974 Kistner ..... 273/54 B X 4,198,709 4/1980 Clayton ..... 273/54 B X 4,228,548 10/1980 Cohen ..... 273/54 B X

OTHER PUBLICATIONS

Bowling Magazine, H & S Distributing, Inc. advertisement, Jan. 1981, p. 7.

*Primary Examiner*—Anton O. Oechsle

*Attorney, Agent, or Firm*—James J. Conlon; Paul A. Kerstein

[57] ABSTRACT

A hand support for bowling formed of a rigid material shaped to cover the back portion of a hand over the second to fifth metacarpals, the entire little finger, and the proximal phalanges of the third and fourth fingers.

5 Claims, 7 Drawing Figures

HAND SUPPORT FOR BOWLING

BACKGROUND AND BRIEF SUMMARY OF THE INVENTION

The present invention relates to a support device to be worn on the hand of a bowler, and more particularly to such a device providing support and positioning guidance for the little finger of the hand when grasping, swinging, and releasing a bowling ball.

The support device of the present invention is formed of a stiff material, such as a hard plastic, sheet metal, or the like, and covers the back side only of portions of the hand. The inside of the hand is essentially unobstructed in its contact and feel of the ball, except for a small flexible fastening strap. This device covers the back of the hand starting approximately from the base of the wrist over the back of the second to fifth metacarpal portion of the hand, a short extension reaches over the back of the third and fourth fingers' proximal phalanges, and a long extension covers the back of the entire fifth or little finger, i.e. over its proximal, middle, and distal phalanges, and beyond. A flexible fastening strap is provided at the base of the device adjacent the base of the wrist to encircle the hand at that point, and a second flexible fastening strap is provided at the short extension portion to encircle the proximal phalanges of the third and fourth fingers. The ends of the third and fourth fingers are unrestrained, as well as the entire thumb and index finger. Thus, the present support device in no way obstructs the grasping of the bowling ball, nor does it in any way interfere with the feel of the ball in the bowlers hand.

Basically the present support device accomplishes three improvements: (1) Because of the stiff backing along the entire little or fifth finger, the bowler is better able to sense and feel the position of the ball throughout the swing, as to whether the hand is "open" or "closed", thereby improving control of the ball release position of the hand. (2) Because of the overall rigidity or bracing of the back of the hand, increased strength is afforded to the bowling hand, and better control of the ball is afforded throughout the swing. (3) Because of the support and additional strength afforded by the device, the hand is better able to move "through" the bowling ball at the point of release, enabling the user to tilt the axis of the ball more forward to impart more effective spin to the ball.

A number of bowling aids designed to assist or brace the bowler's hand and grip, are known in the prior art. The following U.S. patents are illustrative:

U.S. Pat. No. 3,098,654
U.S. Pat. No. 3,224,012
U.S. Pat. No. 3,328,029
U.S. Pat. No. 3,595,575
U.S. Pat. No. 3,606,319
U.S. Pat. No. 4,194,736

These devices are all significantly different from the present invention and do not accomplish the same or equivalent results. None of these devices fully and effectively braces the back side of the little finger of the bowling hand, while leaving the front side of the hand essentially free and unfettered to grasp, feel and control the bowling ball.

It is therefore one object of the present invention to provide a hand support for bowlers.

Another object of the present invention is to provide such a support that braces the back side of the hand.

Another object of the present invention is to provide such a support wherein the front side of the hand is essentially free and unfettered to grasp, feel and control the ball.

Still another object of the present invention is to provide such a support which braces the back side of the entire length of the little finger.

And still another object of the present invention is to provide such a support which also braces the back side of the metacarpal region of the hand over the second to fifth metacarpals.

Other objects and advantages will become apparent to those skilled in the art from a consideration of the exemplary specific embodiment of the invention described hereinafter.

BRIEF DESCRIPTION OF THE DRAWINGS

The following detailed description of one illustrative specific embodiment of the invention is had in conjunction with the accompanying drawings, wherein like numerals refer to like or corresponding parts, and in which.

DETAILED DESCRIPTION

Figure 1:
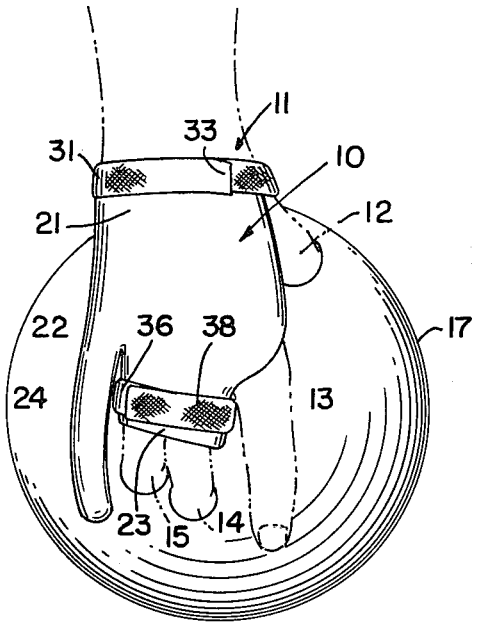
FIG. 1 shows the invention applied to the hand of a bowler grasping a bowling ball, viewing the back of the hand.
Figure 2:
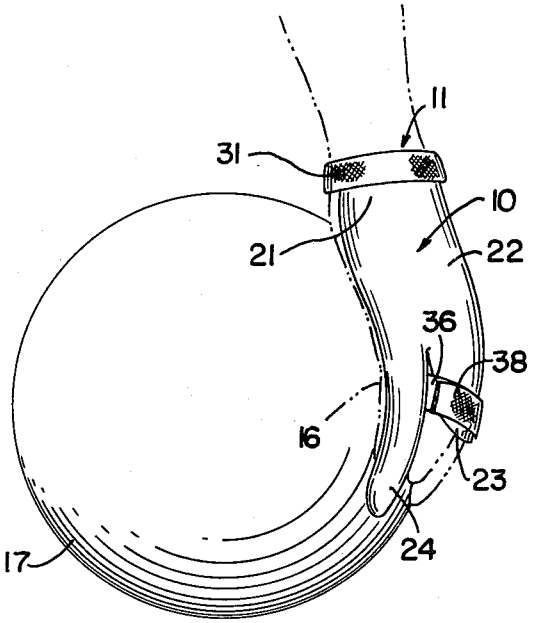
FIG. 2 shows the invention applied to the hand of a bowler grasping a bowling ball, viewing the side of the hand of the littler finger.
Figure 3:
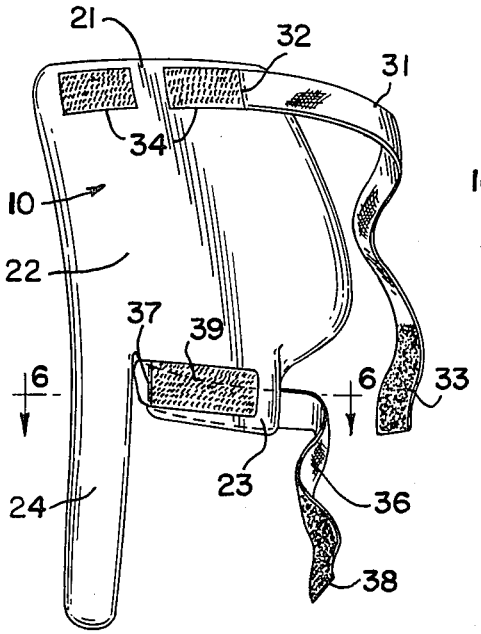
FIG. 3 is a face view of the support of the present invention viewing the outside thereof.
Figure 4:
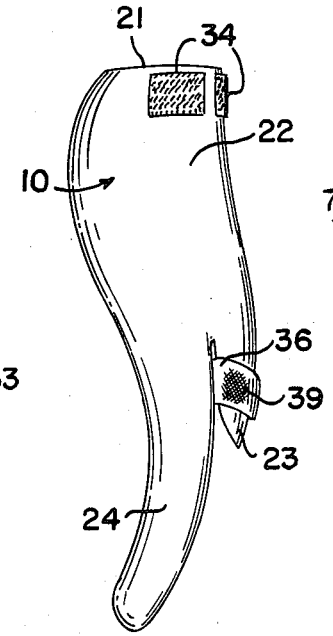
FIG. 4 is an edge view of the support of the present invention viewing the outside thereof along the portion for bracing the little finger of the user.
Figure 5:
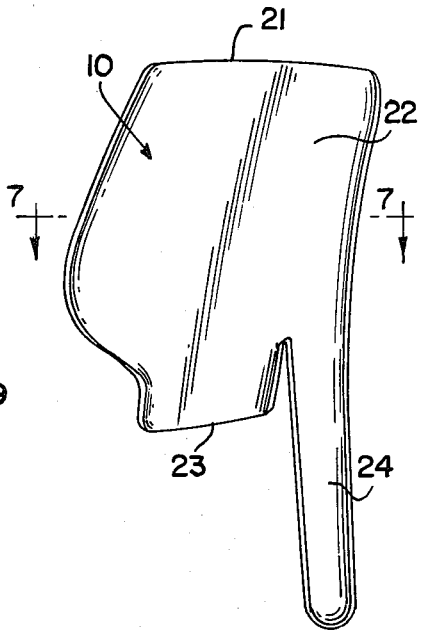
FIG. 5 is a face view of the support of the present invention viewing the inside thereof, with the straps omitted for clarity.
Figure 6:
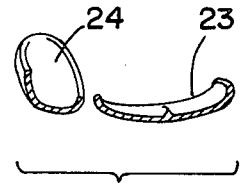
FIG. 6 is a cross sectional view of the support of the present invention taken along the line 6—6 of FIG. 3.
Figure 7:
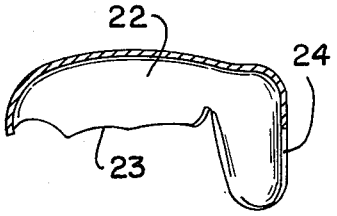
FIG. 7 is a cross sectional view of the support of the present invention taken along the line 7—7 of FIG. 5.

Referring to the accompanying drawings, the support device of the present invention is generally designated by the numeral 10. As shown in FIGS. 1 and 2, the device 10 is intended to be strapped to the bowling hand 11 of a user, whose thumb 12 and second through fourth fingers 13–15 are essentially free to grasp the bowling ball 17 in the normal way. The back of the user's little finger 16 is completely covered.

The base 21 of the support device is located approximately at the end of the wrist of the user. The main body portion 22 covers essentially the back side of the entire second to fifth metacarpal region of the user's hand. At the end of the support opposite from the wrist is a short extension 23 which covers the back side of only the proximal phalanges of the third and fourth fingers 14 and 15. Adjacent this short extension is a long extension 24 which covers the back side of the entire little finger 16, including its proximal, middle, and distal phalanges, and normally extends a little beyond the end of the finger. As seen in FIG. 2, the longitudinal contour of the support device is formed with a curvature that generally conforms to that of the bowling ball, and thereby guides the hand of the user into a cup shape to embrace and grasp the ball 17.

The support device 10 is a stiff or a rigid unit, preferably molded from a hard plastic. However, the device may also be fashioned from a stiffened leather, or from sheet metal, such as aluminum, or a like material.

As shown in the drawings, the support unit 10 is formed to cup over the back of the hand of the user, and pretty much encompass the portion of the hand covered, except for the inside of the hand which is almost completely unobstructed. The unit is retained on the hand preferably by means of two flexible straps. The first is wrist strap 31. One end of this strap is affixed to the base portion 21 of the support at 32, and is drawn tightly around that portion of the hand of the user, as shown in FIGS. 1 and 2, and the end 33 of the strap is then removably fastened to the support unit. Use of a Velcro type fastening strip is perhaps the most convenient, and such is indicated at 34. The second strap 36 is affixed at one end to the short extension 23 at 37, and is drawn tightly around the third and fourth fingers 14, 15 of the user, and its end 38 is removably fastened to the support unit. Again, use of a Velcro fastener 39 is preferred for this purpose.

With the support unit firmly affixed to the back of the hand of a user, it will be appreciated that the device imparts substantial assistance for properly grasping, swinging and releasing a bowling ball, by forcing the hand to embrace the ball in the proper manner. In particular, the little finger is braced against backward movement relative to the ball and the rest of the hand. All this is accomplished without materially affecting the ability of the user to feel and control the ball, as there is essentially no obstruction between the ball and the inside of the hand. The only part of the support unit engaging the inside of the hand is the strap 36, and that is a flexible means engaging only a very small part of the inside of the hand, and which part is relatively unimportant for purpose of ball control.

Having thus described one specific embodiment of the invention for purpose of illustration and to satisfy the requirement for disclosure of best mode of the invention, various modifications and variations of the invention will become apparent to those skilled in the art. Such modifications and variations as are embraced by the spirit and scope of the appended claims are contemplated as being within the purview of the present invention.

What is claimed is:

1. A rigid hand support for bowling, comprising a one piece rigid member shaped to cover a portion of the back of a hand, including a first portion for covering substantially the second to fifth metacarpal region terminating in a base portion adjacent the wrist area of a hand, an extension from said first portion for covering the entire fifth finger of a hand, means for removably attaching said one piece rigid member to the hand of a user whereby said means for removably attaching are the only portion of said support in contact with front side of the user's hand and said one piece rigid member having a longitudinal contour generally proximating the curvature of a bowling ball to thereby guide the user's hand into a cup shape to embrace and grasp the ball.

2. A hand support for bowling as set forth in claim 1, wherein said one piece rigid member includes an additional extension from said first portion for covering the proximal phalanges region of the third and fourth fingers.

3. A hand support for bowling as set forth in claim 1 or 2, wherein said attaching means comprises strap means adapted to encircle a hand to which said rigid member is applied.

4. A hand support for bowling as set forth in claim 3, wherein said strap means includes a strap for encircling the portion of a hand at said base portion of said rigid member.

5. A hand support for bowling as set forth in claim 2, wherein said attaching means includes a frist strap for encircling the portion of a hand at said base portion of said rigid member, and a second strap for encircling the third and fourth fingers of a hand at said additional extension.

* * * * *